US010825407B2

(12) United States Patent
He

(10) Patent No.: US 10,825,407 B2
(45) Date of Patent: Nov. 3, 2020

(54) GAMMA REFERENCE VOLTAGE GENERATOR, METHOD FOR GENERATNG GAMMA REFERENCE VOLTAGE, AND LIQUID CRYSTAL DISPLAY DEVICE

(71) Applicant: Shenzhen China Star Optoelectronics Technology Co., Ltd., Shenzhen, Guangdong (CN)

(72) Inventor: Jian He, Guangdong (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 83 days.

(21) Appl. No.: 15/329,319

(22) PCT Filed: Jan. 13, 2017

(86) PCT No.: PCT/CN2017/071032
§ 371 (c)(1),
(2) Date: Jan. 26, 2017

(87) PCT Pub. No.: WO2018/028151
PCT Pub. Date: Feb. 15, 2018

(65) Prior Publication Data

US 2018/0301099 A1 Oct. 18, 2018

(30) Foreign Application Priority Data

Aug. 11, 2016 (CN) ..... 2016 1 0659395

(51) Int. Cl.
*G09G 3/36* (2006.01)
*G09G 3/20* (2006.01)

(52) U.S. Cl.
CPC ..... *G09G 3/3607* (2013.01); *G09G 3/2018* (2013.01); *G09G 3/3696* (2013.01);
(Continued)

(58) Field of Classification Search
None
See application file for complete search history.

(56) References Cited

U.S. PATENT DOCUMENTS 6,727,874 B2 * 4/2004 Okuzono ..... G09G 3/2011 345/690
6,879,310 B2 * 4/2005 Nose ..... G09G 3/3607 345/88
(Continued)

FOREIGN PATENT DOCUMENTS

CN 1412737 4/2003
CN 101178886 5/2008
(Continued)

OTHER PUBLICATIONS

VLSI Universe, Aug. 1, 2016.*
(Continued)

*Primary Examiner* — Chad M Dicke

(57) ABSTRACT

Disclosed are a gamma reference voltage generator, a method for generating a gamma reference voltage and a liquid crystal display device comprising the gamma reference voltage generator. The gamma reference voltage generator includes a timing control module; a programmable gamma chip, which is electrically connected to the timing control module; and a multiplexing module, which is electrically connected to the timing control module and the programmable gamma chip. Independent control of gamma reference voltages of sub-pixel units of the liquid crystal display device can be achieved, by means of which display quality of images can be improved.

9 Claims, 2 Drawing Sheets

(a)

| EM0 | EM1 | gating |
|---|---|---|
| 0 | 0 | none |
| 0 | 1 | R |
| 1 | 0 | G |
| 1 | 1 | B |

(b)

(52) U.S. Cl.
CPC ..... *G09G 2320/0276* (2013.01); *G09G 2320/0673* (2013.01)

(56) References Cited

U.S. PATENT DOCUMENTS

| | | | | |
|---|---|---|---|---|
| 7,368,990 | B2 * | 5/2008 | Tsuchi | H03F 3/45179 330/253 |
| 7,656,376 | B2 * | 2/2010 | Chiou | G09G 3/20 345/89 |
| 2008/0094334 | A1 * | 4/2008 | Baek | G09G 3/3677 345/89 |
| 2009/0096816 | A1 * | 4/2009 | Kamijo | G09G 3/3688 345/690 |
| 2010/0165007 | A1 * | 7/2010 | Kim | G09G 3/2011 345/690 |
| 2010/0182300 | A1 * | 7/2010 | Kato | G09G 3/3685 345/211 |
| 2011/0157249 | A1 * | 6/2011 | Park | G09G 3/3275 345/690 |
| 2012/0320096 | A1 * | 12/2012 | Small | G09G 3/2003 345/690 |
| 2013/0181965 | A1 * | 7/2013 | Su | G09G 3/3696 345/211 |
| 2017/0162108 | A1 * | 6/2017 | Jo | G09G 3/2092 |

FOREIGN PATENT DOCUMENTS

| | | |
|---|---|---|
| CN | 101499231 | 8/2009 |
| CN | 102165511 | 8/2011 |
| CN | 102376275 | 3/2012 |
| CN | 106297690 | 1/2017 |
| KR | 100540566 | 1/2006 |

OTHER PUBLICATIONS

International Search Report and Written Opinion for International Application No. PCT/CN2017/071032, dated Apr. 28, 2017.
Chinese Office Action and Search Report for Chinese Patent Application No. 201610659395.5 dated Jun. 30, 2017.

* cited by examiner (a)

| EM0 | EM1 | gating |
|---|---|---|
| 0 | 0 | none |
| 0 | 1 | R |
| 1 | 0 | G |
| 1 | 1 | B |

(b)

GAMMA REFERENCE VOLTAGE GENERATOR, METHOD FOR GENERATNG GAMMA REFERENCE VOLTAGE, AND LIQUID CRYSTAL DISPLAY DEVICE

CROSS-REFERENCE TO RELATED APPLICATIONS

This application claims the priority of Chinese patent application CN 201610659395.5, entitled "Gamma reference voltage generator, method for generating gamma reference voltage, and liquid crystal display device" and filed on Aug. 11, 2016, the entirety of which is incorporated herein by reference.

FIELD OF THE INVENTION

The present disclosure relates to the technical field of display technology, and in particular, to a gamma reference voltage generator used in a liquid crystal display, a method for generating gamma reference voltage, and a liquid crystal display device comprising the gamma reference voltage generator.

BACKGROUND OF THE INVENTION

With the development of the display technology, thin film transistor liquid crystal display (TFT-LCD) devices have become a significant display device in modern IT and video products.

A plurality of pixel units are arranged on an array substrate of a liquid crystal display; usually, each pixel unit is composed of sub-pixel units of at least three different colors, which are red (R), green (G) and blue (B). The brightness shown by each sub-pixel unit is determined by Gamma reference voltage. FIG. 1 is a schematic diagram showing a circuit producing gamma reference voltage and providing it to a display panel in the current liquid crystal display device. Based on FIG. 1, it can be seen that gamma reference voltage is usually produced by a single gamma chip 10 and then it is provided to a source driver circuit 20; on the basis of received gamma reference voltage, the source driver circuit converts a digital signal containing image information to an analog signal; then the analog signal is transferred to each sub-pixel unit of a panel 30 via a data line and each sub-pixel unit thus emits light to display a corresponding image. Here, gamma reference voltage is produced merely by the single gamma chip. This means that the sub-pixel units of three different colors, which are red, green and blue, must share a same group of gamma reference voltages. The circuit structure of this design is relatively simple; however, there exists the following defects:

1) the brightnesses of the sub-pixel units of three different colors, which are red, green and blue, cannot be corrected, respectively;
2) coordinates of a white point in a gray scale cannot be corrected by adjusting a gamma reference voltage, which is not benefit for improving the display property of the panel.

SUMMARY OF THE INVENTION

In order to solve the abovementioned problem, the present disclosure provides a new gamma reference voltage generator, a method for generating gamma reference voltage, and a corresponding liquid crystal display device, which aim to produce multiple groups of gamma reference voltages so as to improve the display quality of the liquid crystal display device under the condition of not adding the number of gamma chips.

The gamma reference voltage generator provided in the present disclosure comprises:

a timing control module;

a programmable gamma chip, which is electrically connected to the timing control module and used to generate, under control of the timing control module, corresponding multiple groups of gamma reference voltages based on data information characterizing multiple groups of gamma reference voltage values; and a multiplexing module, which is electrically connected to the timing control module and the programmable gamma chip, and is used to selectively turn on a corresponding channel thereof based on a multiplexed control signal output by the timing control module, and to output one group of gamma reference voltages of the multiple groups of gamma reference voltages received from the programmable gamma chip to a corresponding sub-pixel unit of a display device.

According to an embodiment of the present disclosure, in the abovementioned gamma reference voltage generator, a storage unit is arranged in the timing control module and the storage unit is used to store the data information characterizing multiple groups of gamma reference voltage values.

According to an embodiment of the present disclosure, in the abovementioned gamma reference voltage generator, the programmable gamma chip is configured to generate the corresponding multiple groups of gamma reference voltages in a time-division mode based on the data information characterizing multiple groups of gamma reference voltage values.

According to an embodiment of the present disclosure, in the abovementioned gamma reference voltage generator, the multiplexed control signal output by the timing control module includes two channels of digital signals, which are used to control the multiplexing module to output three groups of gamma reference voltages in a time-division mode and supply the three groups of gamma reference voltages to red, green and blue sub-pixel units, respectively.

According to an embodiment of the present disclosure, the abovementioned gamma reference voltage generator further comprises:

a voltage hold circuit, which comprises regulated branch circuits whose number is the same with that of channels of the multiplexing module, each regulated branch circuit including a storage capacitor and a voltage-follower, wherein an input end of the storage capacitor is electrically connected to an output end of one channel of the multiplexing module, and an output end of the storage capacitor is electrically connected to an input end of the voltage-follower, and wherein an Output end of the voltage-follower is electrically connected to an input end of a source driver circuit of the display device corresponding to a sub-pixel unit.

In addition, the present disclosure further provides a method for generating a gamma reference voltage by using a gamma reference voltage generator. The method comprises steps of:

generating, by the programmable gamma chip corresponding multiple groups of gamma reference voltages wider control of the timing control module based on data information characterizing multiple groups of gamma reference voltage values;

receiving, by the multiplexing module, multiple groups of gamma reference voltages generated by the programmable gamma chip; and when the tuning control module outputs a multiplexed control signal, selectively turning on a channel of the multiplexing module, by the multiplexing module, based on the multiplexed control signal, and outputting one group of gamma reference voltages of the multiple groups of gamma reference voltages to a corresponding sub-pixel unit of a display device.

According to an embodiment of the present disclosure, preferably, the programmable gamma chip is configured to generate the corresponding multiple groups of gamma reference voltages in a time-division mode based on the data information characterizing multiple groups of gamma reference voltage values.

According to an embodiment of the present disclosure, preferably, the multiplexed control signal output by the timing control module includes two channels of digital signals, which are used to control the multiplexing module to output three groups of gamma reference voltages in a time-division mode and supply the three groups of gamma reference voltages to red, green and blue sub-pixel units, respectively.

Moreover, the present disclosure further provides a liquid crystal display device comprising the abovementioned gamma reference voltage generator.

The present disclosure brings about the following beneficial effects.

In the present disclosure, on the basis of time division multiplexing, the timing control module and the multiplexing module are used to cooperate with the single programmable gamma chip to produce multiple groups of gamma reference voltages at one time, which are provided to corresponding sub-pixel units so as to achieve independent control of gamma reference voltages of the sub-pixel units. Moreover, coordinates of a white point in a gray scale can be adjusted by adjusting a gamma reference voltage of a sub-pixel unit, so that color expression of the whole liquid crystal display panel can be enhanced. In addition, compared with existing technologies that use multiple gamma chips, the circuit structure of the present disclosure is relatively simple, convenient for maintenance and can save the cost.

Other features and merits of the present disclosure will be illustrated in the following description. Moreover, part of the features and merits become obvious based on the description or can be understood by carrying out the present disclosure. The purpose and other merits of the present disclosure can be achieved and obtained through the description, the claims and the structures specially indicated in the drawings.

BRIEF DESCRIPTION OF THE DRAWINGS

In order to illustrate the technical solutions in the embodiments of the present disclosure more clearly, the drawings which are required in the description of the embodiments will be introduced simply in the following part.

DETAILED DESCRIPTION OF THE EMBODIMENTS

In the following part, the implementation ways of the present disclosure will be illustrated in detail in conjunction with the figures and the embodiments and thus one can fully understand the process of how to apply the technical means to solve the technical problem in the present disclosure and achieve the corresponding technical effects and carry it out accordingly. Under the no-conflict precondition, the embodiments of the present application and features of the embodiments can be combined with each other; all the formed technical solutions are within the protection scope of the present disclosure.

Embodiment 1

Figure 1:
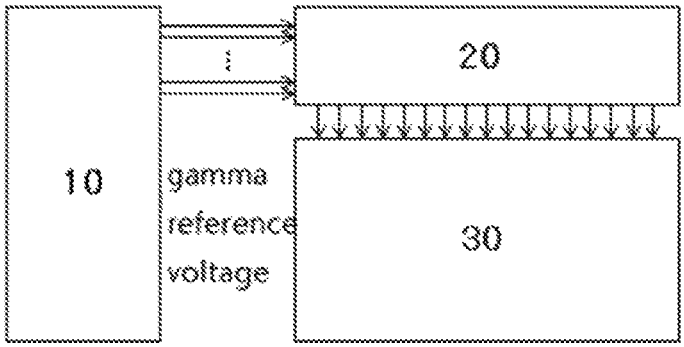
Fig. 1 (Prior Art)
FIG. 1 is a schematic diagram of structure of a circuit producing gamma reference voltages in a current liquid crystal display device.
Figure 2:
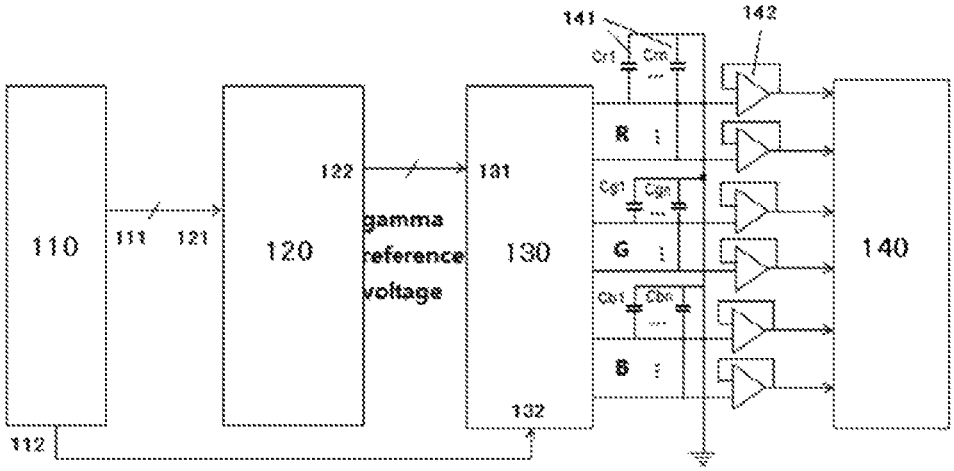
FIG. 2 is a schematic diagram of structure of a circuit of a gamma reference voltage generator provided by an embodiment of the present disclosure.

FIG. 2 is a schematic diagram of structure of a circuit of a gamma reference voltage generator provided by the embodiment of the present disclosure. As shown in FIG. 2, the reference voltage generator mainly comprises a timing control module 110, a digital programmable gamma chip 120 and a multiplexing module 130. Moreover, preferably, in order to maintain a voltage of an analog signal on an input end of a source driving circuit, in this embodiment, the generator further comprises a voltage hold circuit 140.

The timing control module 110 is a timing control chip, which is mainly used to provide a timing control signal. Moreover, in this embodiment, the timing control chip preferably contains a storage unit (not shown in the drawing), for example, a flash memory, which is used to store data information characterizing multiple groups of gamma reference voltages.

The programmable gamma chip 120 is a digital programmable gamma chip. An input end 121 of the chip is electrically connected to an output end 111 of the timing control module 110, so that the programmable gamma chip can preferably receive the data information characterizing multiple groups of gamma reference voltages output by the timing control module 110 in a time division mode before a panel displays an image and generate corresponding multiple groups of gamma reference voltages based on the data information and then output the gamma reference voltages.

The multiplexing module 130 is a digital multiplexing chip. An input end 131 of the chip is electrically connected to an output end 122 of the programmable gamma chip 120 so as to receive the multiple groups of gamma reference voltages output by the programmable gamma chip 120. Meantime, a control end 132 of the chip is electrically connected to another output end 112 of the timing control module 110 so as to receive a multiplexed control signal output by the timing control module 110. Via this design, the multiplexing module 130 can selectively open a corresponding channel based on the multiplexed control signal output by the timing control module 110, and output one group of gamma reference voltages of the multiple groups of gamma reference voltages received from the programmable gamma chip 120 to a corresponding sub-pixel unit of a display device.

In the present embodiment, the multiplexed control signal output by the timing control module 110 includes two channels of digital signals, which are used to control the multiplexing module 130 to output three groups of gamma reference voltages in a time-division way and supply these voltages to red, green and blue sub-pixel units, respectively. Of course, the actual implementation of the present disclosure may not be limited to this. For example, when the multiplexing module possesses eight channels, the timing control module needs to output at least three channels of control signals to control the multiplexing module so as to open one channel of the eight channels.

The voltage hold circuit 140 mainly comprises regulated branch circuits whose number is the same with that of the channels of the multiplexing module 130. Each regulated branch circuit includes a storage capacitor 141 and a voltage-follower 142. An input end of the storage capacitor 141 is electrically connected to an output end of one channel of the multiplexing module 130, and an output end of the storage capacitor 141 is electrically connected to an input end of the voltage-follower 142. An output end of the voltage-follower 142 is electrically connected to an input end of a corresponding sub-pixel unit of a source driver circuit 210 of the display device. When one group of gamma reference voltages output by the multiplexing module 130 are transferred to an input end of the source driving circuit 210 via the voltage hold circuit 140, the storage capacitor 141 in the voltage hold circuit 140 can be charged to a corresponding gamma reference voltage. Accordingly, even if the multiplexing module 130 disconnects its transmission channel, a voltage of the input end of the source driver circuit 140 can still be kept stable. Specific working principles can be found in the illustration of the following embodiment 2.

Embodiment 2

Figure 3:
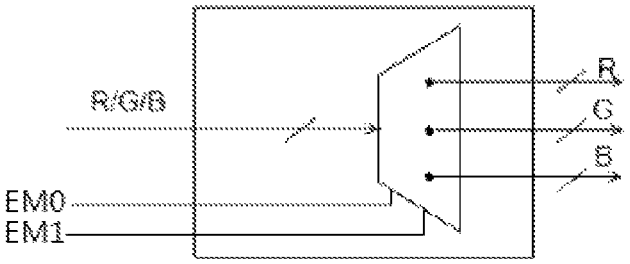
FIGS. 3*a* and 3*b* are schematic diagrams showing multiplexing of a gamma reference voltage generator provided by an embodiment of the present disclosure.

The working principles of the aforementioned gamma reference voltage generator are further described below in conjunction with FIG. 3. The principles are illustrated herein merely based on an example that the timing control module outputs two channels of digital signals, which control the multiplexing module to output three groups of gamma reference voltages in a time-division way and supply these voltages to red, green and blue sub-pixel units, respectively.

As shown in FIGS. 3*a* and 3*b*, the timing control module outputs two channels of control signals. i.e., EM0 and EM1, to the control end of the multiplexing module.

When both EM0 and EM1 are low-level signals, none of the channels of the multiplexing module is turned on. Usually, such a state continues until the multiplexing module receives all the gamma reference voltages, such as the three groups of gamma reference voltages which are used for red, green and blue sub-pixel units, respectively, from the programmable gamma chip.

When EM0 is a low-level signal and EM1 is a high-level signal, only an R channel of the multiplexing module corresponding to the red sub-pixel unit is turned on, i.e., one group of gamma reference voltages corresponding to the red sub-pixel unit in the three groups of gamma reference voltages are transferred to an R input end of the source driver circuit corresponding to the red sub-pixel unit. Correspondingly, capacitors $C_{r1} \ldots C_{rn}$ are charged to corresponding gamma reference voltages so that a voltage of the R input end is maintained at a corresponding gamma reference voltage value.

When EM0 is a high-level signal and EM1 is a low-level signal, only a G channel of the multiplexing module corresponding to the green sub-pixel unit is turned on, i.e., one group of gamma reference voltages corresponding to the green sub-pixel unit in the three groups of gamma reference voltages are transferred to a G input end of the source driver circuit corresponding to the green sub-pixel unit. Correspondingly, capacitors $C_{g1} \ldots C_{gn}$ are charged to corresponding gamma reference voltages so that a voltage of the G input end is maintained at a corresponding gamma reference voltage value.

When both EM0 and EM1 are high-level signals, only a B channel of the multiplexing module corresponding to the blue sub-pixel unit is turned on, i.e., one group of gamma reference voltages corresponding to the blue sub-pixel unit in the three groups of gamma reference voltages are transferred to a B input end of the source driver circuit corresponding to the red sub-pixel unit. Correspondingly, capacitors $C_{b1} \ldots C_{bn}$ are charged to corresponding gamma reference voltages so that a voltage of the B input end is maintained at a corresponding gamma reference voltage value.

After the three groups of gamma reference voltages corresponding to the red, green and blue sub-pixel units are input, all the channels of the multiplexing module are closed and the panel displays corresponding images.

It should be noted that the abovementioned embodiment takes the common RGB sub-pixel units as an example; however, it is also suitable for sub-pixel units of other display modes. For example, it is also suitable for WRGB sub-pixel units.

In addition, the present disclosure further provides a liquid crystal display device. The liquid crystal display device comprises the abovementioned gamma reference voltage generator, and is configured to generate a gamma reference voltage by the foregoing method and supply the gamma reference voltage to a corresponding sub-pixel unit.

The embodiments disclosed in the present disclosure are as above. However, the contents are merely the embodiments for convenient understanding of the present disclosure rather than limiting the present disclosure. Under the condition of not departing from the spirit and scope of the present disclosure, any person skilled in the art can make any amendment and variation towards the implementation mode and details. However, the scope of the present disclosure will still be in accordance with the scope defined in the attached claims.

The invention claimed is:

1. A gamma reference voltage generator, comprising: a timing control module, a programmable gamma chip and a multiplexing module, wherein the timing control module is configured to output a multiplexed control signal to the multiplexing module, the multiplexed control signal includes only two-channels of digital signal;

wherein a storage unit is arranged in the timing control module and the storage unit is used to store data information characterizing multiple groups of gamma reference voltage values;

the programmable gamma chip is electrically connected to the timing control module and used to generate, under control of the timing control module in a time-division mode, corresponding multiple groups of gamma reference voltages based on the data information restored in the storage unit; wherein, the multiple groups of gamma reference voltages are generated as one batch; and the multiplexing module is electrically connected to the timing control module and the programmable gamma chip, and is used to receive the batch comprising the multiple groups of gamma reference voltages, to selectively turn on a corresponding channel thereof based on the multiplexed control signal output by the timing control module and to output one group of gamma reference voltages of the batch comprising the multiple groups of gamma reference voltages received from the programmable gamma chip to a corresponding sub-pixel unit of a display device; wherein, no channel of the multiplexing module is turned on until the multiplexing module receives all of the multiple groups of gamma reference voltages;

wherein the only two-channels of digital signals control a red sub-pixel unit, a green sub-pixel unit, and a blue sub-pixel unit of the display device by adjusting the level of the only two-channels of the digital signals.

2. The gamma reference voltage generator according to claim 1, wherein the only two-channels of digital signals are used to control the multiplexing module to output three groups of gamma reference voltages in a time-division mode and supply the three groups of gamma reference voltages to red, green and blue sub-pixel units, respectively.

3. The gamma reference voltage generator according to claim 1, further comprising a voltage hold circuit, which comprises regulated branch circuits whose number is the same with that of channels of the multiplexing module, each regulated branch circuit including a storage capacitor and a voltage-follower, wherein an input end of the storage capacitor is electrically connected to an output end of one channel of the multiplexing module, and an output end of the storage capacitor is electrically connected to an input end of the voltage-follower, and wherein an output end of the voltage-follower is electrically connected to an input end of a source driver circuit of the display device corresponding to a sub-pixel unit.

4. A method for generating a gamma reference voltage by using a gamma reference voltage generator, wherein the gamma reference voltage generator comprises: a timing control module, a programmable gamma chip and a multiplexing module, wherein the timing control module is configured to output a multiplexed control signal to the multiplexing module, the multiplexed control signal includes only two-channels of digital signal;

wherein a storage unit is arranged in the timing control module and the storage unit is used to store data information characterizing multiple groups of gamma reference voltage values;

the programmable gamma chip is electrically connected to the timing control module and used to generate, under control of the timing control module in a time-division mode, corresponding multiple groups of gamma reference voltages based on the data information restored in the storage unit; and the multiplexing module is electrically connected to the timing control module and the programmable gamma chip, and is used to selectively turn on a corresponding channel thereof based on the multiplexed control signal output by the timing control module and to output one group of gamma reference voltages of the multiple groups of gamma reference voltages received from the programmable gamma chip to a corresponding sub-pixel unit of a display device;

wherein the only two-channels of digital signals control a red sub-pixel unit, a green sub-pixel unit, and a blue sub-pixel unit of the display device by adjusting the level of the only two-channels of the digital signals; and wherein the method comprises steps of:

generating, by the programmable gamma chip, corresponding multiple groups of gamma reference voltages under control of the timing control module based on data information characterizing multiple groups of gamma reference voltage values; wherein, the multiple groups of gamma reference voltages are generated as one batch;

receiving, by the multiplexing module, multiple groups of gamma reference voltages generated by the programmable gamma chip; and when the timing control module outputs only two-channels of digital signals, selectively turning on one of output channels of the multiplexing module, by the multiplexing module, receiving the batch comprising the multiple groups of gamma reference voltages, and based on the only two-channels of digital signals, outputting one group of gamma reference voltages of the batch comprising the multiple groups of gamma reference voltages to a corresponding sub-pixel unit of a display device; wherein, no channel of the multiplexing module is turned on until the multiplexing module receives all of the multiple groups of gamma reference voltages.

5. The method according to claim 4, wherein the only two-channels of digital signals are used to control the multiplexing module to output three groups of gamma reference voltages in a time-division mode and supply the three groups of gamma reference voltages to red, green and blue sub-pixel units, respectively.

6. The method according to claim 4, further comprising:

a voltage hold circuit, which comprises regulated branch circuits whose number is the same with that of channels of the multiplexing module, each regulated branch circuit including a storage capacitor and a voltage-follower, wherein an input end of the storage capacitor is electrically connected to an output end of one channel of the multiplexing module, and an output end of the storage capacitor is electrically connected to an input end of the voltage-follower, and wherein an output end of the voltage-follower is electrically connected to an input end of a source driver circuit of the display device corresponding to a sub-pixel unit.

7. A liquid crystal display device comprising a gamma reference voltage generator, wherein the gamma reference voltage generator comprises: a timing control module, a programmable gamma chip and a multiplexing module, wherein the timing control module is configured to output a multiplexed control signal to the multiplexing module, the multiplexed control signal includes only two-channels of digital signal;

wherein a storage unit is arranged in the timing control module and the storage unit is used to store data information characterizing multiple groups of gamma reference voltage values;

the programmable gamma chip is electrically connected to the timing control module and used to generate, under control of the timing control module in a time-division mode, corresponding multiple groups of gamma reference voltages based on the data information restored in the storage unit; wherein, the multiple groups of gamma reference voltages are generated as one batch; and the multiplexing module is electrically connected to the timing control module and the programmable gamma chip, and is used to selectively turn on a corresponding channel thereof based on the multiplexed control signal output by the timing control module, to receive the batch comprising the multiple groups of gamma reference voltages, and to output one group of gamma reference voltages of the batch comprising the multiple groups of gamma reference voltages received from the programmable gamma chip to a corresponding sub-pixel unit of a display device; wherein, no channel of the multiplexing module is turned on until the multiplexing module receives all of the multiple groups of gamma reference voltages;

wherein the only two-channels of digital signals control a red sub-pixel unit, a green sub-pixel unit, and a blue sub-pixel unit of the display device by adjusting the level of the only two-channels of the digital signals.

8. The liquid crystal display device according to claim 7, wherein the only two-channels of digital signals are used to control the multiplexing module to output three groups of gamma reference voltages in a time-division mode and supply the three groups of gamma reference voltages to red, green and blue sub-pixel units, respectively.

9. The liquid crystal display device according to claim 7, further comprising:

a voltage hold circuit, which comprises regulated branch circuits whose number is the same with that of channels of the multiplexing module, each regulated branch circuit including a storage capacitor and a voltage-follower, wherein an input end of the storage capacitor is electrically connected to an output end of one channel of the multiplexing module, and an output end of the storage capacitor is electrically connected to an input end of the voltage-follower, and wherein an output end of the voltage-follower is electrically connected to an input end of a source driver circuit of the display device corresponding to a sub-pixel unit.

* * * * *